United States Patent [19]

Mettler

[11] 4,274,276

[45] Jun. 23, 1981

[54] METHOD AND APPARATUS FOR PRODUCING A WORKPIECE BY EXTRUSION MOLDING

[75] Inventor: Karl Mettler, Vaduz, Liechtenstein

[73] Assignee: Etablissement Supervis, Vaduz, Liechtenstein

[21] Appl. No.: 929,716

[22] Filed: Jul. 31, 1978

[51] Int. Cl.[3] ..... B21J 13/02

[52] U.S. Cl. ..... 72/354; 72/358; 264/320; 264/DIG. 64; 264/DIG. 66; 425/352; 425/392; 425/394; 425/DIG. 35; 425/DIG. 38

[58] Field of Search ..... 264/320, 322, DIG. 64, 264/DIG. 66; 425/352, 354, 355, 390, 394, 395, DIG. 35, DIG. 38, DIG. 41, 392; 72/354, 358

[56] References Cited

U.S. PATENT DOCUMENTS

| | | | |
|---|---|---|---|
| 1,702,278 | 2/1929 | Simons | 425/DIG. 35 |
| 2,045,471 | 6/1936 | Kasen | 264/322 X |
| 2,269,313 | 1/1942 | Klocke | 264/320 X |
| 2,377,351 | 6/1945 | Martin | 425/394 |
| 2,377,599 | 6/1945 | Allen | 425/394 |
| 2,422,325 | 6/1947 | Wheelon | 264/320 X |
| 2,586,336 | 2/1952 | Huck | 72/354 X |
| 2,763,228 | 9/1956 | Lawson | 72/354 X |
| 3,021,570 | 2/1962 | Podesta et al. | 425/DIG. 35 |
| 3,080,839 | 3/1963 | Fein et al. | 72/354 X |
| 3,210,805 | 10/1965 | Hanai | 425/394 X |
| 3,214,505 | 10/1965 | Pierkowski et al. | 264/320 X |
| 3,342,915 | 9/1967 | Wanderer | 264/322 X |
| 3,487,139 | 12/1969 | Mojonnier et al. | 264/322 X |
| 3,532,786 | 10/1970 | Coffman | 264/320 X |
| 3,583,198 | 6/1971 | Drallmeier | 72/358 |
| 3,739,052 | 6/1973 | Ayres et al. | 264/322 X |
| 3,750,450 | 8/1973 | Sharp et al. | 264/322 X |
| 3,825,648 | 7/1974 | Kulkarni | 264/322 |
| 3,842,646 | 10/1974 | Kuhn | 72/354 |
| 3,929,959 | 12/1975 | Findlay et al. | 264/322 X |
| 4,120,932 | 10/1978 | Roth | 264/320 X |

FOREIGN PATENT DOCUMENTS

| | | | |
|---|---|---|---|
| 1130575 | 2/1957 | France | 264/320 |
| 839027 | 9/1957 | United Kingdom | 264/320 |
| 1442958 | 7/1976 | United Kingdom | 264/322 |

*Primary Examiner*—Philip Anderson

*Attorney, Agent, or Firm*—Weingarten, Maxham & Schurgin

[57] ABSTRACT

A method for making a centrosymmetrical spider of a universal joint by extrusion molding involves pressing both end faces of a cylindrical blank the same distance towards the center of the blank to force the blank material radially outwards from the center of the cylindrical blank in a stream which is symmetrical relative to the two end faces and into a cavity of a split mold.

Also disclosed is a molding apparatus for practicing the method. The apparatus includes a floating mold. One end of the apparatus can be rigidly fixed to a press for operating the punches which provide the extrusion pressure.

4 Claims, 6 Drawing Figures

METHOD AND APPARATUS FOR PRODUCING A WORKPIECE BY EXTRUSION MOLDING

BACKGROUND OF THE INVENTION

The invention relates to a method and an apparatus for producing a workpiece from a cylindrical blank by extrusion molding.

Various methods of producing cross-heads or spiders for Cardan, or universal joints are known, all of which are very labour-intensive and therefore expensive.

The present invention has the object of providing a method and apparatus by which such workpieces, particularly cross-heads, can be produced more simply and therefore more cheaply.

SUMMARY OF THE INVENTION

In accordance with the present invention, both end faces of a cylindrical blank are pressed the same distance towards the centre of the blank. The blank material is forced radially outwards from the centre into the cavity of a mold in a stream which is symmetrical relative to the two end faces.

This novel method is suitable for producing all kinds of workpieces. According to the present invention, the novel method can be used for producing a cross-head by extruding four pins, uniformly distributed about the circumference, out of the centre of the cylindrical blank.

The apparatus for performing the method is characterised in that a first punch abuts on the lower face of the cylindrical blank and a second punch abuts on the upper end face of the cylindrical blank. Two half-molds are provided which can be moved at the same speed relative to the two punches.

Preferably, a hydraulic piston is fastened to each half-mold. Each piston is displaceably mounted in a cylinder, and each cylinder is filled with a hydraulic fluid.

DETAILED DESCRIPTION OF THE PREFERRED EMBODIMENTS

Figure 1:
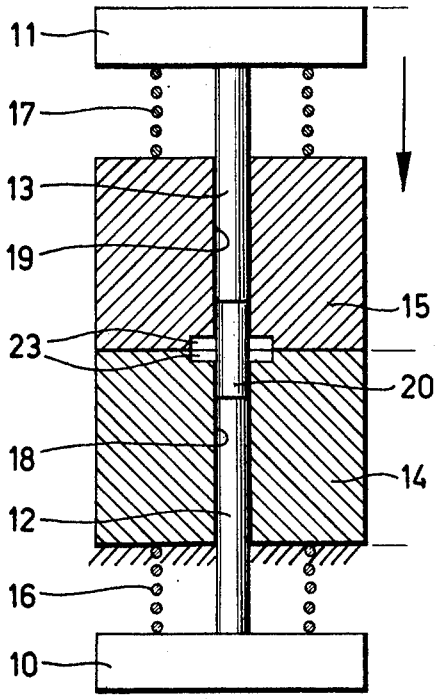
FIG. 1 is a schematic cross-sectional representation of an apparatus for producing a cross-head or spider of a universal joint by extrusion molding in accordance with a preferred embodiment of the present invention and with a blank loaded into the apparatus, but prior to the actual molding step.

According to FIG. 1, an apparatus for performing the novel method according to the present invention comprises two carrier plates 10 and 11. The lower carrier plate 10 is attached to a fixed part of a mechanical or hydraulic press (not shown) and the upper carrier plate 11 is attached to a movable part of this press. An upwardly directed punch 12 is attached to the lower carrier plate 10 and a downwardly directed punch 13 is attached to the upper carrier plate 11. The two punches 12 and 13 are of identical construction and length. Two half-molds 14 and 15 are mounted between the two carrier plates 10 and 10. A compression spring 16 is mounted between the lower carrier plate 11 and the lower half-mold 14, and a second compression spring 17 is mounted between the upper carrier plate 11 and the upper half-mold 15. These two compression springs 16 and 17 urge the two mold halves 14 and 15 to press against each other and provide an elastic connection between the mold halves and their respective punches. FIG. 1 also shows that the lower half-mold 14 has a central bore 18 passing through it, into which the punch 12 projects, and the upper half-mold 15 also has a central bore 19 passing through it into which the punch 13 projects. By means of these bores 18 and 19, the two mold halves 14 and 15 are movably guided on the punches 12 and 13.

Figure 3:
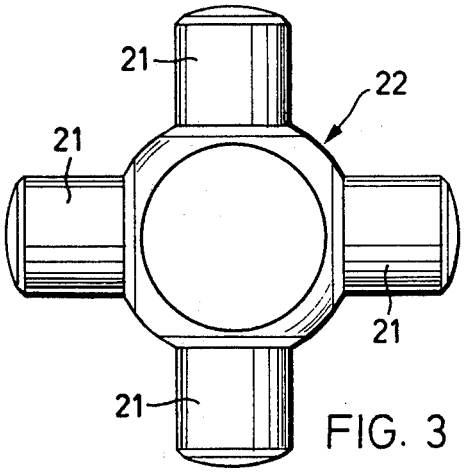
FIG. 3 is a front view of a spider formed in accordance with a preferred embodiment of the present invention.
Figure 4:
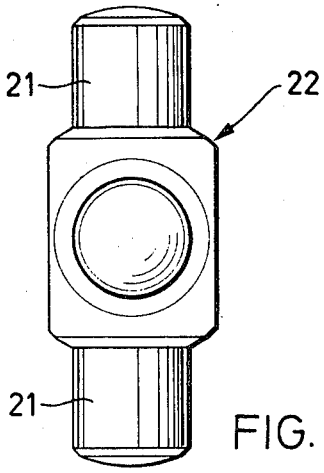
FIG. 4 is a side view of the spider of FIG. 3.

Between the two punches 12 and 13 is a cylindrical blank 20 from which a spider 22 according to FIGS. 3 and 4 is to be produced. The shape of this spider 22 is determined by the recesses in the two halves of the mold 14 and 15.

Figure 2:
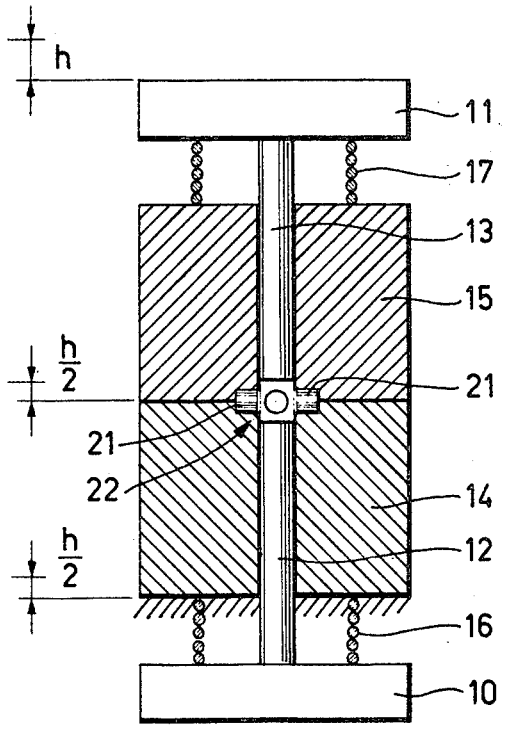
FIG. 2 is a view of the apparatus of FIG. 1 after the molding step has taken place.

As shown in FIG. 2, the spider 22 according to FIGS. 3 and 4 is produced from the blank 20 by pressing the two carrier plates 10 and 11 together by a distance h. As a result of this movement of the upper carrier plate 11 along a distance h, as indicated by the arrow in FIG. 1 the blank 20 is also compacted by an amount equal to the distance h, and material is forced out of the centre of the blank 20 and into the recesses in the mold halves 14 and 15. Since the two compression springs 16 and 17 are equally strong in construction, they are both compressed by the same amount, i.e. each is compressed by an amount equal to h/2. The surfaces along which the two mold halves 14 and 15 abut on each other are thus also moved downwards by an amount equal to h/2, owing to the symmetrical construction of the apparatus shown in FIGS. 1 and 2.

The movably mounted molds are termed "floating molds".

The magnitude of the distance h is derived from the quantity of material which is to be extruded radially outwards, i.e. the larger the four pins 21 in the spider 22 shown in FIGS. 3 and 4, the larger the quantity of material to be forced radially outwards and the greater the required distance h.

According to one embodiment, which is not shown in more detail in the drawing, the two mold halves 14, 15 may be pressed against each other and clamped firmly in place in a special press, in which case the two springs 16 and 17 are not required. However, in this case, the two punches 12 and 13 then have to be actively moved simultaneously towards each other by the same distance h/2. A floating mold would in that case not be necessary.

Figure 5:
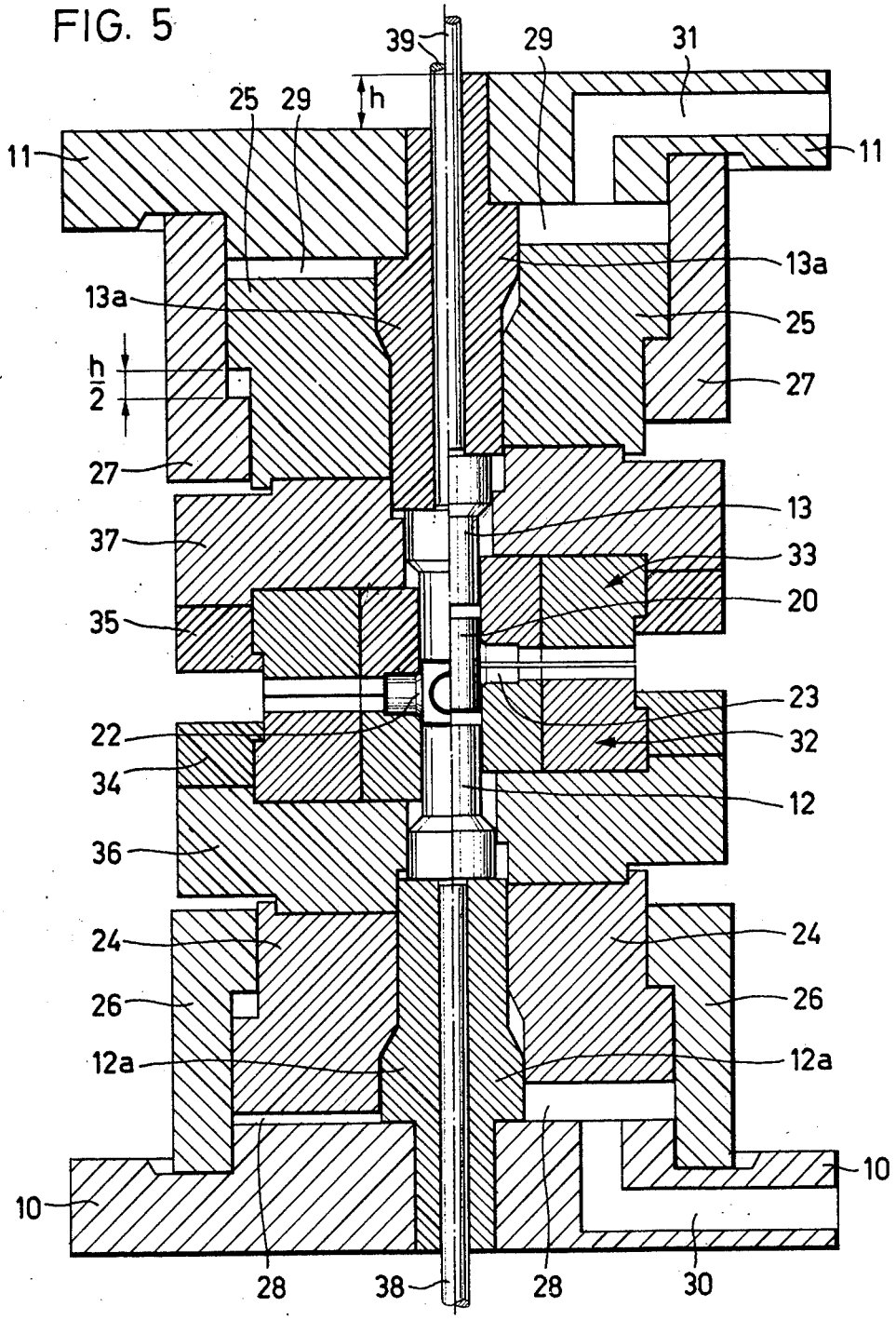
FIG. 5 is a partially sectioned side view of an extrusion molding apparatus in accordance with a preferred embodiment of the present invention. The figure is split into two parts, with the right side showing the apparatus before the extrusion process and the left side showing the apparatus after the extrusion process.

Another exemplary embodiment, shown in FIG. 5, comprises hydropneumatic springs for the floating molds, instead of the compressed air springs 16 and 17, to provide the elastic connections between the mold halves and their respective punches. This will be described in more detail hereinafter.

As before, two carrier plates 10 and 11 are provided, the lower plate 10 being attached to a fixed part of a mechanical or hydraulic press (not shown). The upper carrier plate 11 is attached to a movable part of this press. An upwardly directed punch carrier 12*a* is attached to the lower carrier plate 10 and a downwardly directed punch carrier 13*a* is attached to the upper carrier plate 11. Again, the two punch carriers 12*a* and 13*a* are of identical construction and length. The actual punch 12 is mounted on the lower punch carrier 12*a* and the actual punch 13 is mounted on the upper punch carrier 13*a*, whilst the cylindrical blank 20 is located between the two punches 12 and 13.

A first hydraulic piston 24 is movably mounted on the lower punch carrier 12*a* and a second hydraulic piston 25 is movably mounted on the upper punch carrier 13*a*. These two hydraulic pistons 24 and 25 are movably mounted in two hydraulic cylinders 26 and 27, the lower hydraulic cylinder 26 being fixed on the lower carrier plate 10 and the upper hydraulic cylinder 27 being fixed on the upper carrier plate 11. Chambers 28 and 29, respectively, are formed inside the two hydraulic cylinders 26 and 27 between the carrier plates 10, 11 and the hydraulic pistons 24 and 25. These two chambers 28 and 29 are connected to oil pressure sources (not shown) via lines 30, 31. These sources of oil pressure are formed, for example, by diaphragm tanks, in which the oil is kept under the required pressure by means of a compressed gas, e.g. $N_2$. Diaphragms result in identical pressure in the chambers 28 and 29, and this pressure forces the molds 32 and 33 (which are described in more detail hereinafter) against each other. These two molds 32 and 33 are fixed to two mold carriers 36 and 37 by means of securing rings 34, 35. The mold carriers 36 and 37 are in turn fixed to the hydraulic pistons 24 and 25 by means of securing means, e.g. screws (not shown).

On the surfaces along which the molds 32 and 33 are in contact with each other, these molds comprise recesses corresponding to the shape of the workpiece to be produced, for example the spider shown in FIGS. 3 and 4.

The two punch carriers 12*a* and 13*a* each have a longitudinal bore in which ejector rods 38 and 39, respectively, are movably mounted.

The apparatus shown in FIG. 5 operates as follows:

The two halves of the apparatus described are moved apart, by means of a press (not shown), sufficiently to allow a blank 20 to be inserted between the two punches 12 and 13. When the blank 20 is inserted between the two punches 12 and 13, there is full hydraulic pressure in the two chambers 28 and 29, but the two molds 32 and 33 can still be moved apart sufficiently to leave enough clearance between the molds for the blank 20 to be inserted, since the stroke of the two pistons 24, 25 is limited by stops in the cylinders 26 and 27. In one half of the drawing of FIG. 5, the pistons 24, 25 abut on these stops in the cylinders 26, 27, while in the other half of the drawing there is a clearance of h/2 between the pistons 24, 25 and the stops in the cylinders 26, 27. After the blank 20 has been inserted the two punches 12 and 13 can be moved towards each other, without being forced, until the end faces of the punches 12 and 13 abut on the opposing end faces of the cylindrical blank. As shown in one half of the drawing, the two molds 32 and 33 also abut on each other at this stage. However, with the two punches 12 and 13 in this position, in which they both just make contact with the blank 20, there may still be a small gap between the two molds 32 and 33, but this gap should close up immediately when the blank 20 is compressed, to ensure that no material from the blank 20 penetrates into this gap.

Urged by the force of a press (not shown), the two carrier plates 10 and 11 together with the two punches 12 and 13 are forced towards each other by an amount equal to h and the blank 20 is compressed. Thus, material is forced radially outwards from the central part of the blank 20 and passes into the abovementioned recesses 23 in the molds 12 and 13. During this operation, hydraulic oil is forced out of the two chambers 28 and 29 through the lines 30 and 31 into the diaphragm stores (not shown).

At the same time, each of the two pistons 24 and 25 travels a distance of h/2 in the corresponding cylinder 26 or 27, respectively, as shown in one half of FIG. 5.

As soon as the two punches have moved towards each other by a distance h, the blank 20 has been molded into a spider as shown in FIGS. 3 and 4 by extrusion molding.

The fact that the molds 12 and 13 are mounted in a floating manner means that the lower punch 12 can be immovably fixed to the machine, and only the upper punch 13 need be moved downwardly. The two molds 32 and 33 together move at half the speed, but in the same direction, as the punch 13 when this punch 13 is moved. In this way, the material of the blank is forced into the recesses 23 in the mold in precisely symmetrical manner from above and below.

Figure 6:
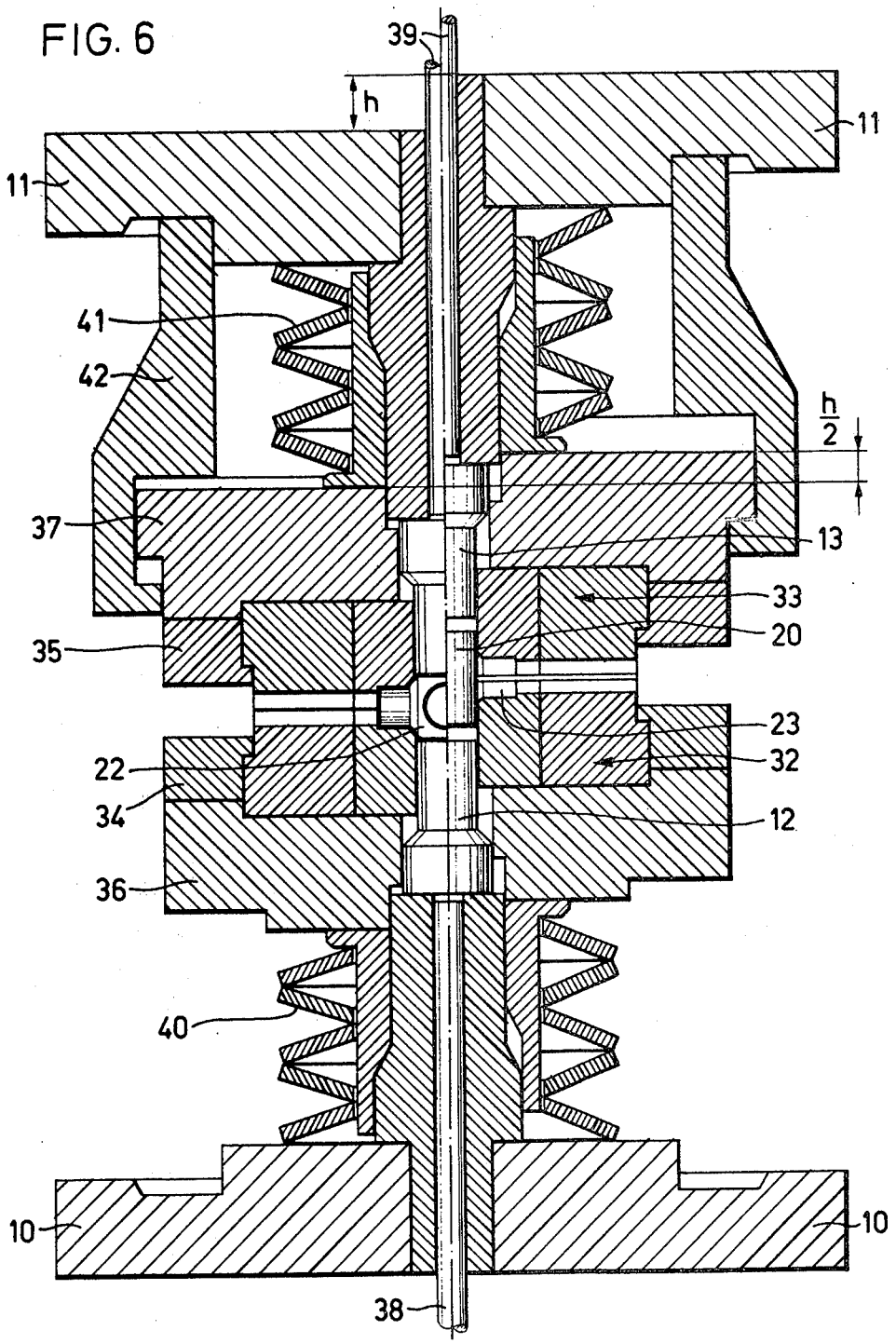
FIG. 6 is a partially sectioned side view of an extrusion molding apparatus in accordance with another preferred embodiment of the present invention. Again, the figure is split into two parts, with the right side showing the apparatus before the extrusion process and the left side showing the apparatus after the extrusion process.

This method can be used to produce not only the spider shown in FIGS. 3 and 4 but also various other centro symmetrical objects, such as cogwheels. FIG. 6 shows the embodiment diagrammatically shown in FIGS. 1 and 2 in somewhat greater detail. A first group of cup springs 40 is mounted between the lower mold carrier 36 and the lower carrier plate 10, and a second group of cup springs 41 is mounted between the upper mold carrier 37 and the upper carrier plate 11. These two groups of springs 40 and 41 are precisely matched to each other, so that the closing pressure for the molds 32 and 33 is attained before the extrusion process takes place, so that the closing pressure is maintained at an adequate level throughout the extrusion process, and to ensure that identical forces are transmitted to the upper and lower molds 33 and 32.

A retraction device 42 is provided for the upper mold carrier 37 with the upper mold 33. The spring elongation is exactly h/2 for both groups of springs 40 and 41.

The method of operation for the embodiment of FIG. 6 is as described for the embodiment shown in FIG. 5.

I claim:

1. A method of producing a workpiece from a blank of cold flowable material by extrusion molding, said method comprising the steps of:

placing said blank in a mold cavity comprising two mold halves symmetrical about a separation line between said mold halves, a fixed punch closing one end of the cavity in the first mold half and a movable punch closing the opposite end of the cavity in the second mold half, the respective mold halves being connected to their punches by elastic means having substantially identical elastic force;

moving said movable punch toward said fixed punch by a predetermined distance; and simultaneously together moving said mold halves toward said fixed punch by a distance substantially equal to half said predetermined distance, whereby said fixed and movable punches travel at the same speed and for the same distance with respect to the separation line, said mold halves remaining stationary with respect to each other;

whereby the pressure on said blank exerted by said fixed punch and said movable punch is symmetrical, said two mold halves move symmetrically with respect to said punches and the material of the workpiece blank flows within the mold cavity symmetrically with respect to the separation line of the mold coincident with the plane between the mold halves.

2. The apparatus of claim 3, and wherein said mold cavity is configured to form said workpiece into a spider for a universal joint.

3. Apparatus for producing a workpiece from a blank of cold flowable material by extrusion molding, said apparatus comprising:

a first fixed carrier plate;

a second carrier plate movable with respect to said first carrier plate;

a first punch mounted on said first carrier plate;

a second punch mounted on said second carrier plate;

a first mold half having a cavity;

first means for elastically coupling said first mold half to said first punch;

a second mold half having a cavity symmetrical with said first mold half cavity;

second means for elastically coupling said second mold half to said second punch, said first and second elastic means having substantially identical elastic force, said mold halves together forming a mold cavity adapted to receive said blank and said punches and having a separation line therebetween, said mold half cavities being symmetrical with respect to the separation line;

means adapted for moving said second carrier plate and said second punch toward said first carrier plate and said first punch by a predetermined distance; and means for moving said mold halves as a unit toward said first carrier plate and said first punch by substantially half of said predetermined distance;

whereby said first and second punches move toward each other into said mold cavity at the same speed and for the same distance with respect to the separation line, thereby extruding said blank into said mold cavity, said separation line being perpendicular to the axes of said punches, thereby forcing the material of said blank symmetrically into said mold cavity with respect to said separation line.

4. The apparatus recited in claim 3 wherein said first and second elastic coupling means comprises a hydraulic piston being mounted to its respective mold half, each hydraulic piston being movably mounted in a cylinder and each said cylinder being filled with a hydraulic pressure fluid.

* * * * *

UNITED STATES PATENT AND TRADEMARK OFFICE

CERTIFICATE OF CORRECTION

PATENT NO. : 4,274,276

DATED : June 23, 1981

INVENTOR(S) : Karl Mettler

It is certified that error appears in the above—identified patent and that said Letters Patent is hereby corrected as shown below:

| | | |
|---|---|---|
| Column 2, | line 15, | "plates 10 and 10." should read --plates 10 and 11.--; |
| | line 16, | "plate 11" should read --plate 10--. |
| Column 4, | line 38, | "centro symmetrical" should read --centro-symmetrical--; |
| | line 38, | "FIG. 6" should begin a new paragraph. |

Signed and Sealed this

*Twenty-sixth* Day of *January 1982*

[SEAL]

*Attest:*

GERALD J. MOSSINGHOFF

*Attesting Officer*

*Commissioner of Patents and Trademarks*